US006164627A

United States Patent [19]

Ravellini

[11] Patent Number: 6,164,627

[45] Date of Patent: Dec. 26, 2000

[54] DEVICE FOR HYDRAULICALLY ACTUATING WINCHES IN A PIPE-LAYING MACHINE

[75] Inventor: Gian Guido Ravellini, Piacenza, Italy

[73] Assignee: VER. POMP. di Felloni Vincenza, Piacenza, Italy

[21] Appl. No.: 09/411,308

[22] Filed: Oct. 4, 1999

[51] Int. Cl.[7] ..... B66D 1/08

[52] U.S. Cl. ..... 254/361; 254/291; 254/367

[58] Field of Search ..... 254/278, 290, 254/291, 339, 361, 366, 367

[56] References Cited

U.S. PATENT DOCUMENTS

| | | | |
|---|---|---|---|
| 598,277 | 11/1898 | Kanzler et al. | 254/291 |
| 3,273,860 | 9/1966 | Weisenbach | 254/291 |
| 4,088,304 | 5/1978 | Gradert | 254/291 |
| 4,223,871 | 9/1980 | Braithwaite | 254/291 |
| 4,261,451 | 4/1981 | Strong | 254/367 |
| 4,337,926 | 7/1982 | Dehaan | 254/367 |
| 4,398,698 | 8/1983 | Crawford et al. | 254/291 |
| 4,516,755 | 5/1985 | Uchimura | 254/361 |
| 5,398,911 | 3/1995 | Holster | 254/367 |
| 6,012,707 | 1/2000 | Enlund | 254/361 |

*Primary Examiner*—Donald P. Walsh
*Assistant Examiner*—Emmanuel M. Marcelo
*Attorney, Agent, or Firm*—Pillsbury Madison & Sutro LLP

[57] ABSTRACT

The actuating device, in particular for a pipe-laying machine, according to the present invention comprises a first winch (4) and a second winch (5) for respectively operating a movable gripping element along a side arm of said machine and the side arm itself. A main oil-hydraulic circuit (1*a*) is also provided for actuating a first hydraulic motor (6) and a second hydraulic motor (7) respectively associated with said first winch (4) and with said second winch (5), said first hydraulic motor (6) comprising a friction clutch (14) actuated by a secondary oil-hydraulic circuit (1*b*) for controlled free descent.

7 Claims, 2 Drawing Sheets

DEVICE FOR HYDRAULICALLY ACTUATING WINCHES IN A PIPE-LAYING MACHINE

BACKGROUND OF THE INVENTION

The present invention relates to a device for hydraulically actuating winches in a machine for laying pipes, such as pipes for oil and gas pipelines for example.

These machines are of the type comprising a motor unit provided with a side arm having one end hingeably connected to the motor unit itself. The side arm is therefore able to rotate with respect to the motor unit, being operated by a cable wound onto a winch rotatably mounted on the machine itself.

The side arm also comprises a cable extending along the whole length of the side arm itself. This cable is wound onto a winch coaxial with the winch for operation of the side arm and, at its free end, comprises a hook for fixing the pipes to be laid.

The winch operating the side arm and the winch operating the cable provided with a hook are actuated by hydraulic motors which are located inside the winches themselves and controlled by the operator via an oil-hydraulic circuit.

Adjustment of the movement of the hook and the side arm, in particular variation in the direction of rotation of the winches and stoppage of the winches, is performed by directly operating the respective hydraulic motors.

The pipe-laying machines must be able to work in series, namely the pipe is supported by several pipe-laying machines which operate in the vicinity of the zone where the pipe itself is laid.

In the event, for example, of the ground giving way, the load would be borne by only some of the pipe-laying machines and this situation could result in overturning of the pipe-laying machines which are still in operation.

Moreover, in the hydraulic actuating devices of the known type, the hydraulic pump functions constantly, irrespective of the required operation of the winches, with consequent overheating of the hydraulic oil and therefore restrictions on the use of the machine in particular in desert zones or zones where there are particularly high temperatures.

SUMMARY OF THE INVENTION.

The object of the present invention is to eliminate the abovementioned drawbacks by providing an actuating device for a pipe-laying machine which allows the controlled free descent of the pipe in the event of giving way of the ground where several machines are operating in series and the controlled descent also in the case of stoppage of the diesel engine of the machine.

A further object of the present invention is that of preventing overheating of the hydraulic oil as a result of continuous operation of the hydraulic pump and therefore allowing use of the machine also in extreme climatic conditions.

Said objects are fully achieved by the device for actuating winches in pipe-laying machines, according to the present invention, as described by the contents of the claims below, and in particular comprising a main oil-hydraulic circuit which is provided with a main hydraulic pump and a hydraulic friction clutch operationally associated with said main hydraulic pump.

Moreover, in the device according to the present invention the first hydraulic motor comprises a friction clutch actuated by a secondary oil-hydraulic circuit for controlled free descent.

BRIEF DESCRIPTION OF THE DRAWINGS

These and other characteristic features will emerge more clearly from the following description of a preferred embodiment illustrated purely by way of a non-limiting example in the accompanying plates of drawings, in which.

DESCRIPTION OF THE PREFERRED EMBODIMENTS

Figure 1:
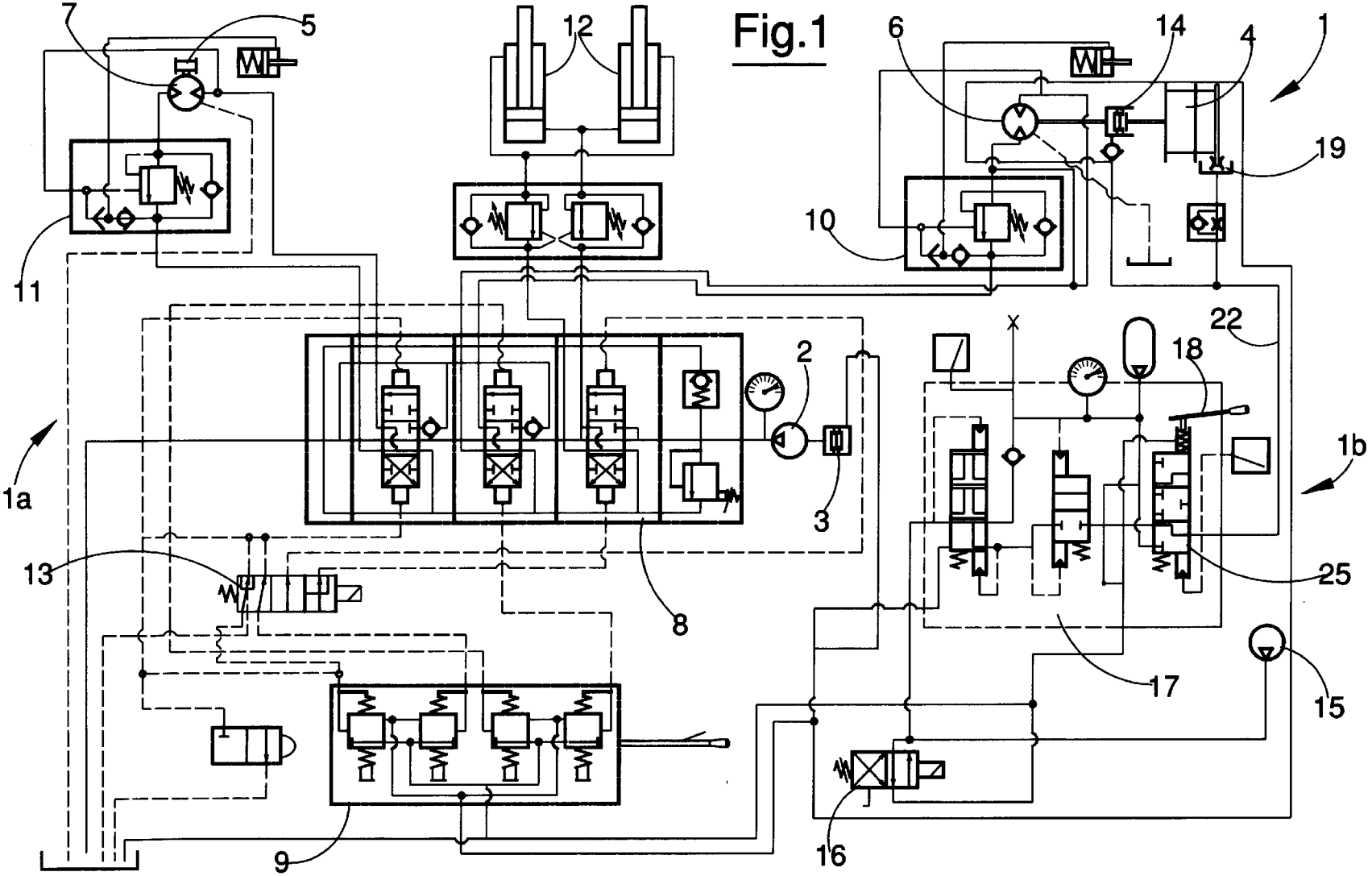
FIG. 1 shows a diagram of the oil-hydraulic circuit for actuating winches in a pipe-laying machine.

With reference to the figures, 1 denotes in its entirety an oil-hydraulic circuit forming part of a device for actuating winches in a pipe-laying machine.

This machine is of an essentially known type and therefore is not fully illustrated in the figures. In particular, this laying machine is composed of a motor unit provided with a side arm which is hingeably connected to the motor unit itself so as to be able to rotate rigidly with respect thereto.

A cable runs along the side arm and has, connected to its free end, a gripping element essentially consisting of a hook to which a pipe, for example a pipe for an oil pipeline, may be fixed.

The movement imparted to the gripping element and therefore to the pipe fixed thereto is provided by a combination of the rigid rotational movement of the side arm with respect to the motor unit and the vertical translatory movement of the gripping element with respect to the side arm, the latter movement being produced by travel of the support cable along the side arm itself.

The diesel engine of the motor unit is equipped with a speed-increasing gear for adapting the revs of the diesel engine to those of a main hydraulic pump 2. The speed-increasing gear in an original manner contains a hydraulic friction clutch 3 which activates the main hydraulic pump 2 only when operation of the arm and/or the hook is required in order to avoid overheating of the hydraulic oil.

The actuating device according to the present invention therefore comprises a first winch 4 which is mounted rotatably on the machine and around which the cable provided with the gripping element or hook is wound.

Said actuating device also comprises a second winch 5 which is mounted rotatably on said machine and around which a cable operating the side arm is wound.

The first winch 4 and the second winch 5 are positioned so that they are coaxial and have, inside them, respectively a first hydraulic motor 6 and a second hydraulic motor 7 for effecting rotation of the two winches.

The two hydraulic motors are operated by the oil-hydraulic circuit 1, in particular by a main oil-hydraulic circuit 1*a* illustrated in FIG. 1.

This main oil-hydraulic circuit 1*a* comprises the main hydraulic pump 2 which operates the first and the second winches 4 and 5 via a distributor element 8.

By means of the distributor element 8 it is possible to select the direction of rotation of the respective hydraulic motor 6 and 7 and therefore the respective winch 4 and 5, so as to select lowering or raising of the gripping element and/or rotation in either direction of the side arm.

The distributor element 8 is actuated by the servocontrols 9 by means of manual operation performed by the operator.

The main oil-hydraulic circuit 1*a* also comprises a first control valve 10 and a second control valve 11 which are associated respectively with the first hydraulic motor 6 and the second hydraulic motor 7.

In addition to the first and second hydraulic motors 6 and 7, the main oil-hydraulic circuit 1 a controls the movement of a counterweight 12 by means of a valve 13.

Furthermore, the first hydraulic motor 6, which actuates the first winch 4 so as to effect the movement of the gripping element, advantageously comprises a friction clutch 14.

Figure 2:
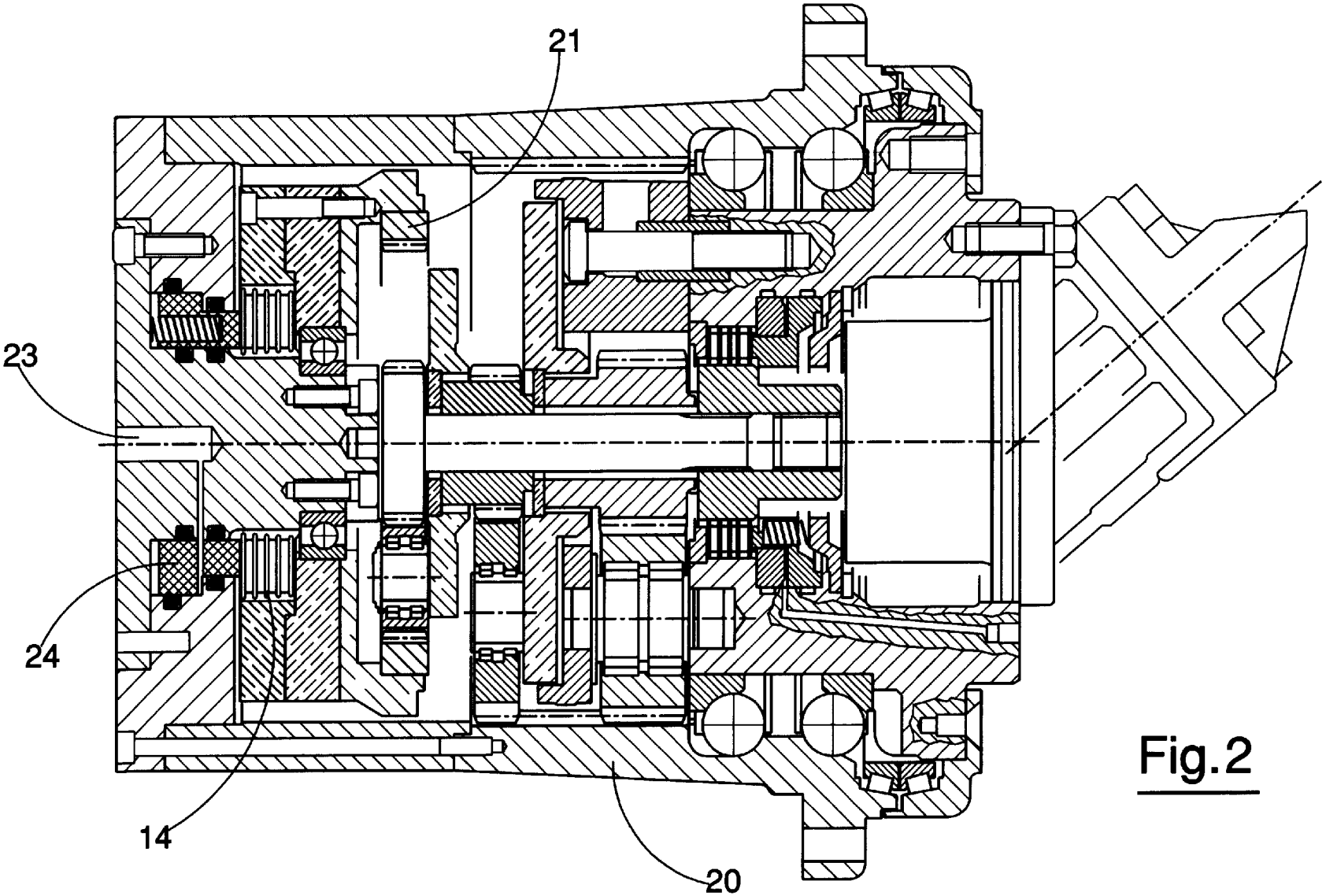
FIG. 2 illustrates a detail of the machine.

In accordance with that illustrated in FIG. 2, the friction clutch 14 is operationally associated with the respective first hydraulic motor 6 and housed inside the first winch 4, being mounted directly on a reduction gear 20, and in particular on a first crown wheel 21 of the reduction gear 20. The purpose of the friction clutch 14 is to allow the free falling movement, namely to render idle the drum of the first winch 4 with respect to the reduction gear 20.

In particular the free falling movement is obtained by disengaging the friction clutch 14 which, being connected to the crown wheel 21 of the reduction gear 20, consequently disengages said first crown wheel 21 and therefore the drum of the first winch 6 from the reduction gear 20.

The friction clutch 14 is advantageously actuated by a secondary oil-hydraulic circuit 1*b* for controlled free descent. In particular the secondary oil-hydraulic circuit 1*b* comprises a secondary pump 15, a solenoid valve 16, controls 17 for the free falling movement and the servocontrols 9.

The secondary circuit 1*b* causes the free falling movement by operating a lever 18 which disengages the friction clutch 14, as illustrated above.

Operation of the lever 18 creates pressure inside a pipe 22 of the secondary circuit 1*b* and the oil under pressure reaches a duct 23 and interacts with a piston 24 which in turn disengages the friction clutch 14. Consequently this disengages the first crown wheel 21 of the reduction gear 20 and hence the drum of the first winch 4 from the axis of the reduction gear 20 itself. Moreover a disk brake 19 is mounted on the drum of the first winch 4 in order to adjust the falling speed of the load. This disk brake 19 is operated, together with the friction clutch 14, by the secondary circuit 1*b* via a pressure-control valve 25.

What is claimed:

1. An actuating device in particular for a pipe-laying machine, comprising:

a first winch (4) mounted rotatably on said machine for operating a movable gripping element along a side arm of said machine;

a second winch (5) mounted rotatably on said machine for operating said side arm;

a main oil-hydraulic circuit (1*a*) for actuating a first hydraulic motor (6) and a second hydraulic motor (7) respectively associated with said first winch (4) and said second winch (5), said first hydraulic motor (6) comprising a friction clutch (14) actuated by a secondary oil-hydraulic circuit (1*b*) for controlled free descent.

2. The device as claimed in claim 1, wherein said friction clutch (14) is mounted directly on a reduction gear (20) and acts on a first crown wheel (21) of the reduction gear (20) itself so as to disengage said first winch (4) from said reduction gear (20).

3. The device as claimed in claim 2, wherein said friction clutch (14) is operated by a piston (24) connected to said secondary circuit (1*b*).

4. The device as claimed in claim 1, wherein said secondary oil-hydraulic circuit (1*b*) for controlled free descent comprises a secondary pump (15).

5. The device as claimed in claim 1, wherein said secondary oil-hydraulic circuit (1*b*) for controlled free descent comprises a lever (19) which can be operated manually.

6. The device as claimed in claim 1, wherein said first winch (4) also comprises a brake (19) actuated by said secondary oil-hydraulic circuit (1*b*) for controlled free descent.

7. The device as claimed in claim 1, wherein said main oil-hydraulic circuit (1*a*) comprises a main hydraulic pump (2) and a hydraulic friction clutch (3) which is operationally associated with said main hydraulic pump.

* * * * *